US009314942B2

(12) United States Patent
Nishino et al.

(10) Patent No.: US 9,314,942 B2
(45) Date of Patent: Apr. 19, 2016

(54) INGOT CUTTING APPARATUS AND INGOT CUTTING METHOD

(75) Inventors: Hidehiko Nishino, Nishishirakawa (JP); Yoshihiro Hirano, Nishishirakawa (JP); Shigeharu Tsunoda, Nishishirakawa (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 1242 days.

(21) Appl. No.: 13/121,269

(22) PCT Filed: Oct. 8, 2009

(86) PCT No.: PCT/JP2009/005236

§ 371 (c)(1), (2), (4) Date: Mar. 28, 2011

(87) PCT Pub. No.: WO2010/052827

PCT Pub. Date: May 14, 2010

(65) Prior Publication Data

US 2011/0174285 A1 Jul. 21, 2011

(30) Foreign Application Priority Data

Nov. 7, 2008 (JP) ..... 2008-286138

(51) Int. Cl.
*B28D 5/04* (2006.01)
*B28D 5/00* (2006.01)
(Continued)

(52) U.S. Cl.
CPC ..... *B28D 5/0076* (2013.01); *B08B 3/123* (2013.01); *B08B 7/028* (2013.01); *B28D 5/045* (2013.01); *Y10T 83/263* (2015.04)

(58) Field of Classification Search
CPC ..... B23D 55/00; B28D 5/0076; B08B 7/028; B08B 3/123
USPC ..... 125/16.01, 16.02, 21
See application file for complete search history.

(56) References Cited

U.S. PATENT DOCUMENTS 2,815,562 A * 12/1957 Wilkie et al. ..... 83/169
2,992,663 A * 7/1961 Hendrickson ..... 83/522.14
3,097,675 A * 7/1963 Benedict ..... 83/169
(Continued)

FOREIGN PATENT DOCUMENTS

EP 0432288 A1 * 6/1991 ..... B28D 1/025
JP 59110514 A * 6/1984
(Continued)

OTHER PUBLICATIONS

International Preliminary Report on Patentability issued in International Application No. PCT/JP2009/005236 dated Jun. 21, 2011.
(Continued)

*Primary Examiner* — Lee D Wilson
*Assistant Examiner* — Joel Crandall
(74) *Attorney, Agent, or Firm* — Oliff PLC

(57) ABSTRACT

An ingot cutting apparatus having at least one coolant pocket storing the coolant to be supplied to the blade, wherein the blade-abrasive-grain portion is brought into contact with the coolant stored in the at least one coolant pocket by causing the blade-abrasive-grain portion of the blade to travel through a groove portion provided at an upper portion of the at least one coolant pocket while driving to rotate the blade so that the coolant is supplied to the blade.

12 Claims, 3 Drawing Sheets

(51) Int. Cl.
*B08B 3/12* (2006.01)
*B08B 7/02* (2006.01)

(56) References Cited

U.S. PATENT DOCUMENTS

| | | | | | |
|---|---|---|---|---|---|
| 3,104,575 | A * | 9/1963 | Robinson | 83/168 |
| 3,104,576 | A * | 9/1963 | Robinson | 83/169 |
| 3,615,309 | A * | 10/1971 | Dawson | 51/309 |
| 3,848,493 | A * | 11/1974 | Harris | 83/168 |
| 4,274,389 | A * | 6/1981 | White et al. | 125/21 |
| 4,355,555 | A * | 10/1982 | Kobayashi et al. | 83/62.1 |
| 4,501,181 | A * | 2/1985 | Yakich | 83/169 |
| 4,502,184 | A * | 3/1985 | Karubian | 452/160 |
| 4,766,790 | A * | 8/1988 | Harris | 83/56 |
| 5,201,305 | A | 4/1993 | Takeuchi | |
| 6,021,772 | A * | 2/2000 | Seifert et al. | 125/13.02 |
| 6,178,962 | B1 * | 1/2001 | Ohashi et al. | 125/16.01 |
| 6,390,896 | B1 * | 5/2002 | Huber et al. | 451/59 |
| 6,543,434 | B2 * | 4/2003 | Holzmuller et al. | 125/21 |
| 6,612,913 | B2 * | 9/2003 | Bailey et al. | 451/59 |
| 6,832,606 | B2 * | 12/2004 | Yamada et al. | 125/13.01 |
| 6,837,778 | B2 * | 1/2005 | Kondo et al. | 451/49 |
| 7,228,855 | B2 * | 6/2007 | Yamasaki et al. | 125/21 |
| 7,306,508 | B2 * | 12/2007 | Kawasaki et al. | 451/7 |
| 8,240,236 | B2 * | 8/2012 | Benz | 83/169 |
| 2001/0017130 | A1 * | 8/2001 | Ohmori et al. | 125/16.01 |
| 2006/0174862 | A1 | 8/2006 | Yamasaki et al. | |
| 2010/0006082 | A1 * | 1/2010 | Glinski et al. | 125/16.02 |

FOREIGN PATENT DOCUMENTS

| | | |
|---|---|---|
| JP | A-01-316162 | 12/1989 |
| JP | A-09-183118 | 7/1997 |
| JP | A-11-198020 | 7/1999 |
| JP | A-2000-334653 | 12/2000 |
| JP | 2006-218652 A | 8/2006 |
| JP | A-2007-054913 | 3/2007 |
| JP | A-2008-080734 | 4/2008 |

OTHER PUBLICATIONS

Japanese Office Action issued in Japanese Application No. 2008-286138 dated Oct. 2, 2012 (w/partial translation).

Apr. 24, 2012 Office Action issued in Japanese Patent Application No. 2008-286138 (with partial translation).

International Search Report issued in International Patent Application No. PCT/JP2009/005236, dated Nov. 17, 2009.

Dec. 18, 2014 Office Action issued in Korean Application No. 10-2011-7009498.

Jun. 26, 2015 Office Action issued in Korean Application No. 10-2011-7009498.

* cited by examiner

INGOT CUTTING APPARATUS AND INGOT CUTTING METHOD

TECHNICAL FIELD

The present invention relates to an ingot cutting apparatus for cutting an ingot, particularly a single crystal silicon ingot pulled by the Czochralski method (the CZ method) and the like and a cutting method by using the same.

BACKGROUND ART

A silicon ingot produced by the CZ method and the like has a cylindrical body portion and cone-shaped end portions (a top portion and a tail portion). In processing of the silicon ingot, these cone-shaped end portions are cut away to separate the cylindrical body portion, and the body portion is cut into a plurality of blocks as needed. The blocks are thereafter subjected to processing for obtaining wafers.

An inner diameter slicer and an outer diameter slicer or the like have been frequently used for the case of the cutting processing of the cone-shaped end portions and the cutting processing of the body portion into a plurality of blocks. As the diameter of the wafer becomes larger in recent years, a band saw also has become to be frequently used.

Here, FIG. 6 shows an outline of a method for cutting into a block in the case of using a band saw for an ingot cutting apparatus.

As shown in FIG. 6, a cutting table 105 for supporting the ingot at the time of cutting is arranged in the ingot cutting apparatus 101. Moreover, in the ingot cutting apparatus 101, an endless-belt blade (a band saw) 102 is provided in a tensioned state between pulleys 103 and 103', and the blade includes a blade-abrasive-grain portion having abrasive grains of diamond adhered to an end portion of a thin blade base.

The ingot 104 is horizontally placed on the cutting table 105 before cutting. A position where the ingot 104 is placed is adjusted so that a cutting position of the ingot 104 corresponds to that of the blade 102.

The blade 102 is driven to rotate by rotating the pulleys 103 and 103', and the ingot 104 is cut by relatively feeding the blade 102 from above to below against the ingot 104. In this point, a coolant is supplied to the blade 102 for the purpose of, for example, removing processing heat at a cutting area and cutting chips. The coolant is supplied mainly through a nozzle 108 for spraying the coolant.

As the cutting is repeated, cutting capacity becomes low because some abrasive grains are buried due to accumulation of cutting powder on the blade-abrasive-grain portion and the like. Therefore, the blade is periodically subjected to dressing process.

A conventional ingot cutting apparatus and method, however, has a problem that the coolant is not sufficiently supplied to the blade-abrasive-grain portion of the blade 102, which operates upon the cutting most, and consequently the processing heat and the cutting chips cannot be sufficiently removed.

With regard to this problem, there is disclosed a band saw cutting apparatus and a cutting method that allegedly enables the coolant to be sufficiently supplied by spraying the coolant through a spray nozzle from the side of a cutting direction of the blade to an edge portion of the blade (See Patent Literature 1).

CITATION LIST

Patent Literature

Patent Literature 1: Japanese Unexamined Patent publication (Kokai) No. 2000-334653

SUMMARY OF INVENTION

However, the coolant is not sufficiently supplied in some cases by the conventional supply method of the coolant with the nozzle as above. In particular, when an ingot having a large diameter of 300 mm or more is cut, a sufficient amount of coolant does not reach the vicinity of the center of the ingot, and a cooling effect on the cutting area and a removing effect on the cutting chips cannot be sufficiently exerted in some cases. As a result, there arises a problem of a decrease in cutting precision, such as the generation of sori on a cutting surface, due to an increase in the temperature of the cutting area. There are also problems that the diamond abrasive grains of the blade oxidize and deteriorate due to the temperature of the cutting area becoming 700° C. or more, and the lifetime of the blade decreases due to an influence of minute vibration of the blade generated by the accumulation of fine cutting powder on the blade-abrasive-grain portion.

The present invention was accomplished in view of the above-explained problems, and its object is to provide an ingot cutting apparatus and an ingot cutting method that enable the cooling effect on the cutting area and the cleaning effect on the blade-abrasive-grain portion to be improved by efficiently supplying the coolant to the blade-abrasive-grain portion, and by sufficiently supplying the coolant particularly even when the ingot having a large diameter is cut.

To achieve this object, the present invention provides an ingot cutting apparatus including a cutting table on which an ingot is horizontally placed, and an endless-belt blade provided in a tensioned state between pulleys, the blade having a blade-abrasive-grain portion and a blade base, the ingot cutting apparatus cutting the ingot by relatively feeding the blade from above to below against the ingot while driving to rotate the blade by rotating the pulleys and supplying a coolant to the blade, the ingot cutting apparatus comprising at least one coolant pocket storing the coolant to be supplied to the blade, wherein the blade-abrasive-grain portion is brought into contact with the coolant stored in the at least one coolant pocket by causing the blade-abrasive-grain portion of the blade to travel through a groove portion provided at an upper portion of the at least one coolant pocket while driving to rotate the blade so that the coolant is supplied to the blade.

In this manner, when the ingot cutting apparatus comprises the at least one coolant pocket storing the coolant to be supplied to the blade, and when the blade-abrasive-grain portion is brought into contact with the coolant stored in the at least one coolant pocket by causing the blade-abrasive-grain portion of the blade to travel through a groove portion provided at an upper portion of the at least one coolant pocket while driving to rotate the blade so that the coolant is supplied to the blade, the coolant can be supplied efficiently and sufficiently by putting the coolant on the blade-abrasive-grain portion, and the cooling effect on the cutting area and the cleaning effect on the blade-abrasive-grain portion can be thereby improved. As a result, the cutting precision can be improved by suppressing sori on the cutting surface and the like, and production cost can be reduced by improving the lifetime of the blade. In addition to these, a frequency of the dressing process for the blade can be reduced by improving the cleaning effect on the blade-abrasive-grain portion, and productivity can be consequently improved.

In this case, the pulleys can be configured to be rotatable about an axis thereof in both directions, and a direction of driving to rotate the blade can be changed to cut the ingot.

In this manner, when the pulleys are configured to be rotatable about an axis thereof in both directions, and when the direction of driving to rotate the blade can be changed to cut the ingot, a displacement amount of an edge deflection of the blade can be suppressed to a low level by changing the direction of the edge deflection of the blade between before and after the change of the direction of driving to rotate the blade. As a result, the cutting precision of the ingot can be more effectively improved, and the lifetime of the blade can be more surely improved.

In this case, the ingot cutting apparatus can comprise at least two coolant pockets, and at least one of the coolant pockets can be arranged at respective positions of a front and a rear of the ingot with respect to a direction of driving to rotate the blade.

In this manner, when the ingot cutting apparatus comprises at least two coolant pockets, and when at least one of the coolant pockets is arranged at the respective positions of the front and the rear of the ingot with respect to the direction of driving to rotate the blade, the coolant can be sufficiently supplied to the cutting area regardless of the direction of driving to rotate the blade. In addition to this, an increase of the coolant pocket for supplying the coolant enables the cleaning effect of the coolant on the blade to be more surely improved.

In this case, the coolant is preferably pure water having a specific resistance of 17 MΩ·cm or more.

In this manner, when the coolant has high permeability, such as the pure water having a specific resistance of 17 MΩ·cm or more, the coolant easily permeates between the blade and the ingot at the time of cutting, and thereby the coolant can be more effectively supplied.

In this case, the ingot cutting apparatus can comprise an ultrasonic wave propagation means for applying an ultrasonic wave to the coolant stored in the at least one coolant pocket.

In this manner, when the ingot cutting apparatus comprises the ultrasonic wave propagation means for applying an ultrasonic wave to the coolant stored in the at least one coolant pocket, the cleaning effect on the blade can be more surely improved by applying the ultrasonic wave to the coolant.

In this case, the ingot can be a silicon ingot having a diameter of 300 mm or more.

In this manner, even when the ingot is the silicon ingot having a diameter of 300 mm or more, the coolant can be supplied efficiently and sufficiently by putting the coolant on the blade-abrasive-grain portion, according to the present invention, and the cooling effect on the cutting area and the cleaning effect on the blade-abrasive-grain portion can be thereby improved.

Furthermore, the present invention provides an ingot cutting method including: horizontally placing an ingot on a cutting table; providing an endless-belt blade in a tensioned state between pulleys, the blade having a blade-abrasive-grain portion and a blade base; driving to rotate the blade by rotating the pulleys; and cutting the ingot by relatively feeding the blade from above to below against the ingot while supplying a coolant to the blade, wherein at least one coolant pocket for supplying the coolant to the blade is arranged, the coolant is stored in the at least one coolant pocket, and the coolant is supplied to the blade in such a manner that the blade-abrasive-grain portion is brought into contact with the coolant stored in the at least one coolant pocket by causing the blade-abrasive-grain portion of the blade to travel through a groove portion provided at an upper portion of the at least one coolant pocket while driving to rotate the blade.

In this manner, when at least one coolant pocket for supplying the coolant to the blade is arranged, the coolant is stored in the at least one coolant pocket, and the coolant is supplied to the blade in such a manner that the blade-abrasive-grain portion is brought into contact with the coolant stored in the at least one coolant pocket by causing the blade-abrasive-grain portion of the blade to travel through a groove portion provided at an upper portion of the at least one coolant pocket while driving to rotate the blade, the coolant can be supplied efficiently and sufficiently by putting the coolant on the blade-abrasive-grain portion, and the cooling effect on the cutting area and the cleaning effect on the blade-abrasive-grain portion can be thereby improved. As a result, the cutting precision can be improved by suppressing sori on the cutting surface and the like, and production cost can be reduced by improving the lifetime of the blade. In addition to these, a frequency of the dressing process for the blade can be reduced by improving the cleaning effect on the blade-abrasive-grain portion, and productivity can be consequently improved.

In this case, it is possible that after the ingot is cut with the blade driven to rotate in one direction, a direction of driving to rotate the blade is changed into a direction opposite to the one direction, and thereafter the ingot is continuously cut or a next ingot is cut.

In this manner, when after the ingot is cut with the blade driven to rotate in one direction, the direction of driving to rotate the blade is changed into the direction opposite to the one direction, and thereafter the ingot is continuously cut or a next ingot is cut, a displacement amount of an edge deflection of the blade can be suppressed to a low level by changing the direction of the edge deflection of the blade between before and after the change of the direction of driving to rotate the blade. As a result, the cutting precision of the ingot can be more effectively improved, and the lifetime of the blade can be more surely improved.

In this case, it is possible that the at least one coolant pocket is arranged at respective positions of a front and a rear of the ingot with respect to a direction of driving to rotate the blade, and the coolant is supplied through at least two of the arranged coolant pockets.

In this manner, when at least one coolant pocket is arranged at the respective positions of the front and the rear of the ingot with respect to a direction of driving to rotate the blade, and the coolant is supplied through at least two of the arranged coolant pockets, the coolant can be sufficiently supplied to the cutting area regardless of the direction of driving to rotate the blade. In addition to this, an increase of the coolant pocket for supplying the coolant enables the cleaning effect of the coolant on the blade to be more surely improved.

In this case, pure water having a specific resistance of 17 MΩ·cm or more is preferably used as the coolant.

In this manner, when pure water having a specific resistance of 17 MΩ·cm or more is used as the coolant, the coolant easily permeates between the blade and the ingot at the time of cutting, and thereby the coolant can be more effectively supplied.

In this case, it is possible that an ultrasonic wave is applied to the coolant stored in the at least one coolant pocket, and the blade-abrasive-grain portion is cleaned by the coolant to which the ultrasonic wave is applied while driving to rotate the blade.

In this manner, when an ultrasonic wave is applied to the coolant stored in the at least one coolant pocket, and the blade-abrasive-grain portion is cleaned by the coolant to which the ultrasonic wave is applied while driving to rotate the blade, the cleaning effect on the blade can be more surely improved.

In this case, a silicon ingot having a diameter of 300 mm or more can be used as the ingot.

In this manner, even when the silicon ingot having a diameter of 300 mm or more is used as the ingot, the coolant can be supplied efficiently and sufficiently by putting the coolant on the blade-abrasive-grain portion, according to the present invention, and the cooling effect on the cutting area and the cleaning effect on the blade-abrasive-grain portion can be thereby improved.

In the present invention, the ingot cutting apparatus comprises the at least one coolant pocket storing the coolant to be supplied to the blade, and the blade-abrasive-grain portion is brought into contact with the coolant stored in the at least one coolant pocket by causing the blade-abrasive-grain portion of the blade to travel through the groove portion provided at the upper portion of the at least one coolant pocket while driving to rotate the blade so that the coolant is supplied to the blade. Therefore, the coolant can be efficiently supplied by putting the coolant on the blade-abrasive-grain portion, it can be sufficiently supplied particularly even when the ingot having a large diameter is cut, and the cooling effect on the cutting area and the cleaning effect on the blade-abrasive-grain portion can be thereby improved. As a result, the cutting precision can be improved by suppressing sori on the cutting surface and the like, and the production cost can be reduced by improving the lifetime of the blade. In addition to these, the frequency of the dressing process for the blade can be reduced by improving the cleaning effect on the blade-abrasive-grain portion, and the productivity can be consequently improved.

DESCRIPTION OF EMBODIMENTS

Hereinafter, an embodiment according to the present invention will be explained, but the present invention is not restricted thereto.

With regard to cutting of an ingot by an ingot cutting apparatus, there are instances that the coolant is not sufficiently supplied to the cutting area in a conventional coolant supply with a nozzle spray. In particular, when an ingot having a large diameter of 300 mm or more is cut, the coolant does not sufficiently reach the vicinity of the center of the ingot, and the cooling effect and the removing effect on the cutting chips cannot be exerted in some cases. As a result, there arises problems of the decrease in cutting precision, the deterioration of the diamond abrasive grains of the blade due to oxidation, or the decrease in lifetime of the blade due to the generation of minute vibration of the blade by the accumulation of fine cutting powder on the blade-abrasive-grain portion.

In view of this, the present inventor repeatedly keenly conducted studies to solve these problems. As a result, the present inventor has conceived that since the coolant hits the blade-abrasive-grain portion at water pressure at the time of spraying it from the nozzle and is splashed with its reaction in a conventional supply of the coolant with a nozzle, the coolant is hard to attach to the blade-abrasive-grain portion, and insufficient supply is resulted from this, that is, difficulty in management of an appropriate amount of coolant that is to be put on the blade-abrasive-grain portion.

Moreover, the present inventor has conceived that a sufficient amount of coolant can be efficiently supplied with it put on the blade-abrasive-grain portion by causing the blade-abrasive-grain portion to travel through the groove portion provided at the upper portion of the coolant pocket storing the coolant, instead of supplying the coolant by spraying it from the nozzle. The present inventor also has investigated the best mode for carrying out these, and thereby brought the present invention to completion.

Figure 1:
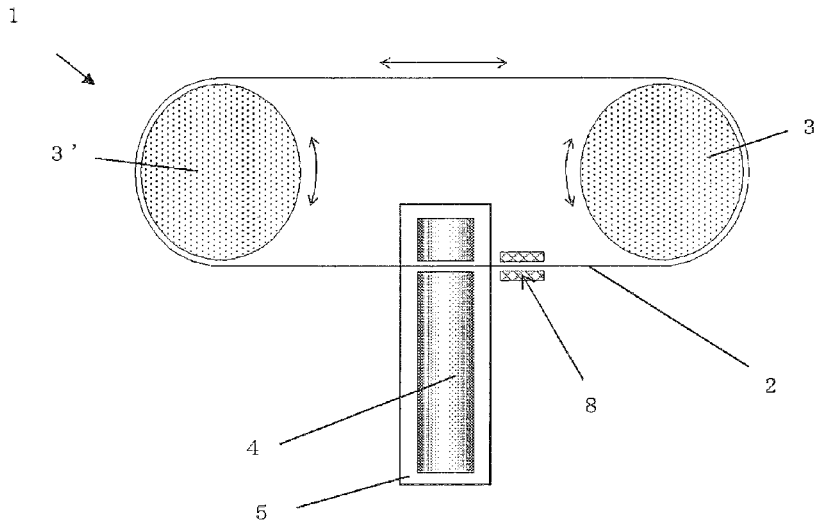
FIG. 1 is a schematic top view showing an example of the ingot cutting apparatus according to the present invention.

FIG. 1 is a schematic top view showing an example of the ingot cutting apparatus according to the present invention.

As shown in FIG. 1, a band saw can be used for the ingot cutting apparatus.

The ingot cutting apparatus 1 according to the present invention includes the cutting table 5 for placing the ingot 4 at the time of cutting, the blade 2 for cutting the ingot 4, the pulleys 3 and 3' for providing the blade 2 in a tensioned state and driving to rotate the blade, and the like.

Figure 2:
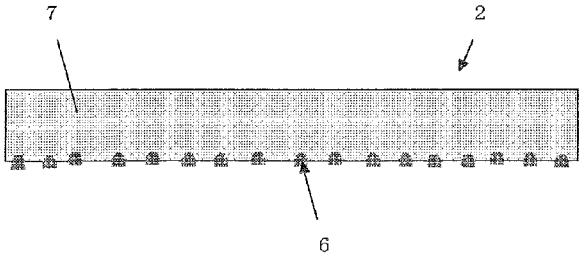
FIG. 2 is a schematic view showing the blade that can be used in the ingot cutting apparatus according to the present invention.

The blade 2 is formed in an endless-belt shape, and has the blade-abrasive-grain portion 6 having abrasive grains of diamond adhered to the end portion of a thin blade base 7, as shown in FIG. 2.

Here, a grain size of the blade-abrasive-grain portion 6 is not restricted in particular. For example, the grain size may be a size of #120 to #220. The shape of the abrasive grain can be semicircular or rectangular. When the abrasive grain has such a symmetrical shape, the direction of driving to rotate the blade 2 does not affect a cutting surface of the ingot 4. The thickness of the blade-abrasive-grain portion may be 0.4 to 0.9 mm (the thickness of the blade base is 0.1 to 0.5 mm). But this is not restricted in particular.

The pulleys 3 and 3' are configured to be rotatable about an axis thereof. The blade 2 is provided in a tensioned state between the pulleys 3 and 3'. The blade 2 can be driven to rotate by rotating the pulleys 3 and 3'. Here, the traveling speed at which the blade 2 is driven to rotate may be 600 to 1400 m/min. But this is not restricted in particular.

Figure 3:
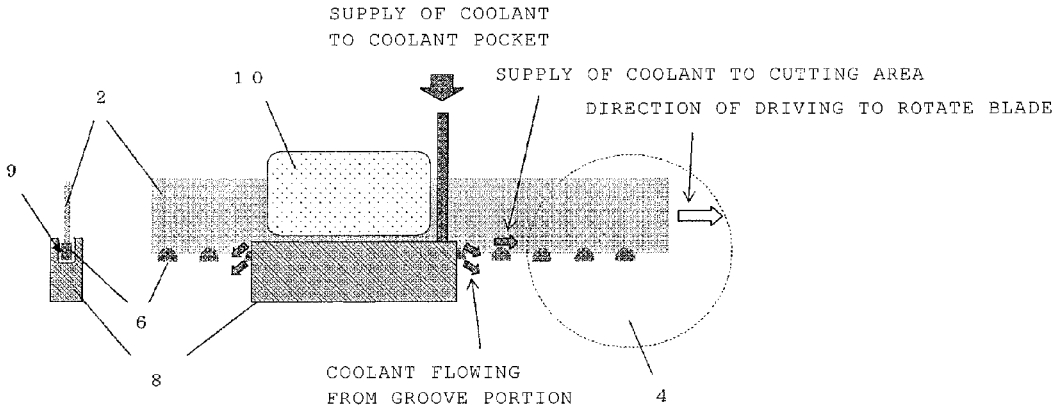
FIG. 3 a schematic explanatory view showing a condition where the coolant stored in the coolant pocket of the ingot cutting apparatus according to the present invention is supplied to the blade.

Moreover, the ingot cutting apparatus according to the present invention includes at least one coolant pocket 8 for supplying the coolant to the blade 2. As shown in FIG. 3, the groove portion 9 is provided at the upper portion of the coolant pocket 8, and the blade-abrasive-grain portion 6 of the blade 2 can travel through the groove portion 9. The coolant can be stored in the coolant pocket 8 by supplying the coolant to the groove portion 9.

A pair of static pressure pads 10 can be also arranged at predetermined intervals with facing to one another so as to allow passage of the blade 2 to suppress the vibration of the blade 2 during cutting.

In the ingot cutting apparatus 1 according to the present invention configured as described above, the blade-abrasive-grain portion 6 is brought into contact with the coolant stored in the coolant pocket 8 by causing the blade-abrasive-grain portion 6 of the blade 2 to travel through the groove portion 9 provided at the upper portion of the coolant pocket 8 while driving to rotate the blade so that the coolant is supplied to the blade 2, and the blade-abrasive-grain portion 6 is made to abut on the ingot 4 to cut the ingot 4 by relatively feeding the blade 2 from above to below against the ingot 4.

With the ingot cutting apparatus 1 according to the present invention configured as described above, a sufficient amount of coolant can be efficiently supplied with it put on the blade-abrasive-grain portion 6, it can be sufficiently supplied particularly even when the ingot having a large diameter is cut, and the cooling effect on the cutting area and the cleaning effect on the blade-abrasive-grain portion 6 can be thereby improved. As a result, the cutting precision can be improved by suppressing sori on the cutting surface and the like. In addition, the lifetime of the blade 2 can be improved by suppressing the accumulation of cutting powder on the blade-abrasive-grain portion 6, which may cause minute vibration of the blade 2, and the production cost can be thereby reduced. Furthermore, the frequency of the dressing process for the blade 2 can be reduced by improving the cleaning effect on the blade-abrasive-grain portion 6, process time can be thereby reduced, and the productivity can be consequently improved.

In accordance with the present invention, the temperature of the cutting area can be suppressed to approximately 100° C. when a silicon ingot having a large diameter of, for example, 300 mm or more is cut. The deterioration of the diamond abrasive grains due to oxidation can be prevented which is conventionally caused by the temperature of the cutting area increasing to 700° C. or more because of an insufficient supply of the coolant, in the cutting of the silicon ingot having such a large diameter.

In this case, as shown in FIG. 3, at least one of the coolant pocket 8 is preferably arranged at the immediate vicinity of the front of the ingot 4 with respect to the direction of driving to rotate the blade 2, and this enables the coolant that is put on the blade-abrasive-grain portion 6 to be more efficiently supplied to the cutting area of the ingot 4. But this is not restricted in particular.

In this case, the coolant pocket 8 can be also arranged below the static pressure pads 10. When the coolant pocket 8 is arranged at the position of static pressure pads 10 where the vibration of the blade 2 is more suppressed as described above, the coolant can be more stably put on the blade-abrasive-grain portion 6.

The ingot cutting apparatus according to the present invention may be also configured that the coolant pocket 8 is arranged below the static pressure pads 10, a coolant-spraying outlet (not shown) is provided at the surface of the static pressure pads 10 on the side of the blade 2, and the coolant is sprayed toward the blade 2 (the blade base) through the coolant-spraying outlet, so that the vibration of the blade 2 is suppressed and the sprayed coolant is stored in the coolant pocket 8.

In this case, the pulleys 3 and 3' can be also configured to be rotatable about an axis thereof in both directions, and the direction of driving to rotate the blade 2 can be changed to cut the ingot 4. Here, a fixing bolt is desirably provided at the pulleys 3 and 3' so as not to loosen when the rotation direction thereof is changed.

As described above, when the pulleys 3 and 3' are configured to be rotatable about an axis thereof in both directions, and the direction of driving to rotate the blade 2 can be changed to cut the ingot 4, the direction of the edge deflection of the blade 2 is reversed by changing the direction in which the blade-abrasive-grain portion 6 comes into contact with the ingot 4 between before and after the change of the direction of driving to rotate the blade 2, and the displacement amount of the edge deflection of the blade 2 can be thereby suppressed to a low level. As a result, the cutting precision of the ingot 4 can be more effectively improved, and the lifetime of the blade 2 can be more surely improved.

Here, the pulleys may be configured to be one shaft drive in which any one of the two pulleys 3 and 3' can be driven to rotate by itself or two shaft drive in which both pulleys can be driven to rotate by itself.

Moreover, the tension for stretching the blade 2 between the pulleys 3 and 3' may be 1 ton or more, but this is not restricted in particular. When the tension for stretching the blade 2 between the pulleys 3 and 3' is 1 ton or more as described above, even in case of the one shaft drive, the shake of the blade 2 can be prevented from occurring during the rotation regardless of the direction of driving to rotate the blade 2.

Figure 4:
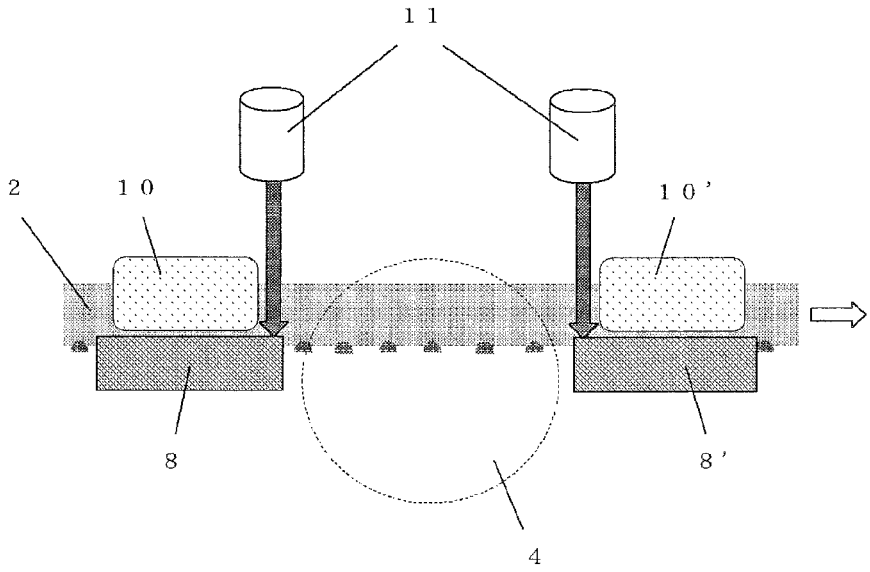
FIG. 4 is a schematic partly enlarged view of another example of the ingot cutting apparatus according to the present invention.

Moreover, as shown in FIG. 4, the ingot cutting apparatus can include at least two coolant pockets, and at least one of the coolant pockets can be arranged at respective positions of the front and the rear of the ingot 4 with respect to the direction of driving to rotate the blade 2.

As described above, when the ingot cutting apparatus includes at least two coolant pockets 8 and 8', and at least one of the coolant pockets is arranged at the respective positions of the front and the rear of the ingot 4 with respect to the direction of driving to rotate the blade 2, the coolant can be sufficiently supplied to the cutting area regardless of the direction of driving to rotate the blade 2. It is not thereby necessary to change the arrangement position of the coolant pockets 8 and 8' depending on the direction of driving to rotate the blade 2. The number of the coolant pockets to be arranged naturally may be equal to or more than 3.

Moreover, when the number of the coolant pockets 8 and 8' for supplying the coolant increases, and particularly the coolant pocket 8' is arranged at the rear of the ingot 4 with respect to the direction of driving to rotate the blade 2, the cleaning effect on the blade 2 by the coolant can be more surely improved.

Moreover, the coolant to be supplied is preferably pure water having a specific resistance of 17 MΩ·cm or more.

As described above, when the coolant has high permeability, such as the pure water having a specific resistance of 17 MΩ·cm or more, the coolant easily permeates between the blade 2 and the ingot 4 at the time of cutting, and thereby the coolant can be more effectively supplied.

In this case, as shown in FIG. 4, the ingot cutting apparatus can include the ultrasonic wave propagation means 11 for applying an ultrasonic wave to the coolant stored in the coolant pockets 8 and 8'.

As described above, when the ingot cutting apparatus includes the ultrasonic wave propagation means 11 for applying the ultrasonic wave to the coolant stored in the coolant pockets 8 and 8', the cleaning effect on the blade 2 can be more surely improved by the coolant to which the ultrasonic wave is applied. At this point, the ultrasonic wave propagation means 11 may be configured so as to apply the ultrasonic wave to the coolant stored in all the arranged coolant pockets 8 and 8', or to apply the ultrasonic wave to some of them only.

Here, the frequency of the ultrasonic wave may be, for example, 400 to 460 KHz and the power thereof may be 13 to 17 W. But these are not restricted in particular.

Moreover, the ingot 4 can be a silicon ingot having a diameter of 300 mm or more.

As described above, even when the ingot 4 is the silicon ingot having a large diameter of 300 mm or more, the coolant can be supplied efficiently and sufficiently by putting the coolant on the blade-abrasive-grain portion 6, according to the present invention, and the cooling effect on the cutting area and the cleaning effect on the blade-abrasive-grain portion 6 can be thereby improved.

Next, the ingot cutting method according to the present invention will be explained.

Hereinafter, the case of using the ingot cutting apparatus according to the present invention as shown in FIG. 1 will be explained.

First, at least one coolant pocket 8 for supplying the coolant to the blade 2 is arranged. The coolant is stored in the coolant pocket 8.

The ingot 4 to be cut is horizontally placed on the cutting table 5. A position where the ingot 4 is placed is adjusted so that a cutting position of the ingot 4 corresponds to that of the blade 2.

The blade 2 is thereafter driven to rotate by rotating the pulleys 3 and 3', and as shown in FIG. 3, the blade-abrasive-grain portion 6 is brought into contact with the coolant stored in the coolant pocket 8 by causing the blade-abrasive-grain portion 6 of the blade 2 to travel through the groove portion 9 provided at the upper portion of the coolant pocket 8 so that the coolant is supplied to the blade 2. The ingot 4 is cut by relatively feeding the blade 2 from above to below against the ingot 4. In this case, the blade 2 may be fed from above to below, or alternatively the ingot 4 may be fed from below to above.

At this point, as shown in FIG. 3, a part of the coolant stored in the coolant pocket 8 is put on the blade-abrasive-grain portion 6 and supplied, and the other part flows outside out of the groove portion 9. The coolant is accordingly supplied to the groove portion 9 of the coolant pocket 8 so that the coolant is always stored in the coolant pocket 8. Here, as described above, it is possible that the coolant pocket 8 is arranged below the static pressure pads 10, and the coolant is sprayed through the coolant-spraying outlet of the static pressure pads 10, so that the vibration of the blade 2 is suppressed and the sprayed coolant is stored in the coolant pocket 8.

Here, the traveling speed at which the blade 2 is driven to rotate may be 600 to 1400 m/min. But this is not restricted in particular.

When the ingot 4 is cut by the method as described above, the coolant can be efficiently supplied to the cutting area by putting the coolant on the blade-abrasive-grain portion 6. In addition to this, particularly even when the ingot 4 having a large diameter is cut, the coolant is sufficiently supplied, and the cooling effect on the cutting area and the cleaning effect on the blade-abrasive-grain portion 6 can be thereby improved. As a result, the cutting precision can be improved by suppressing sori on the cutting surface and the like. In addition, the lifetime of the blade 2 can be improved by suppressing the accumulation of cutting powder on the blade-abrasive-grain portion 6, which may cause minute vibration of the blade 2, and the production cost can be thereby reduced. Furthermore, the frequency of the dressing process for the blade 2 can be reduced by improving the cleaning effect on the blade-abrasive-grain portion 6, and the process time can be thereby reduced to improve the productivity.

In this case, it is possible that after the ingot 4 is cut with the blade 2 driven to rotate in one direction, the direction of driving to rotate the blade 2 is changed into a direction opposite to the one direction, and thereafter the same ingot 4 is continuously cut or a next ingot is cut.

When the direction of driving to rotate the blade 2 is changed as described above, the direction of the edge deflection of the blade 2 is reversed by changing the direction in which the blade-abrasive-grain portion 6 comes into contact with the ingot 4 between before and after the change of the direction of driving to rotate the blade 2, and the displacement amount of the edge deflection of the blade 2 can be thereby suppressed to a low level. As a result, the cutting precision of the ingot 4 can be more effectively improved, and the lifetime of the blade 2 can be more surely improved.

In this case, as shown in FIG. 4, it is possible that the at least one coolant pocket is arranged at respective positions of the front and the rear of the ingot 4 with respect to the direction of driving to rotate the blade 2, and the coolant is supplied through at least two of the arranged coolant pockets 8 and 8'.

As described above, when at least one of the coolant pockets 8 and 8' is arranged at the respective positions of the front and the rear of the ingot 4 with respect to the direction of driving to rotate the blade 2, and the coolant is supplied through at least two of the arranged coolant pockets 8 and 8', the coolant can be sufficiently supplied to the cutting area regardless of the direction of driving to rotate the blade 2. It is not thereby necessary to change the arrangement position of the coolant pockets 8 and 8' depending on the direction of driving to rotate the blade 2.

In addition, when the number of the coolant pockets 8 and 8' for supplying the coolant increases, and particularly the coolant pocket 8' is arranged at the rear of the ingot 4 with respect to the direction of driving to rotate the blade 2, the cleaning effect on the blade 2 by the coolant can be more surely improved.

In this case, pure water having a specific resistance of 17 MΩ·cm or more is preferably used as the coolant.

As described above, when pure water having a specific resistance of 17 MΩ·cm or more is used as the coolant, the coolant easily permeates between the blade 2 and the ingot 4 at the time of cutting, and thereby the coolant can be more effectively supplied.

In this case, as shown in FIG. 4, it is possible that an ultrasonic wave is applied to the coolant stored in the coolant pockets 8 and 8', and the blade-abrasive-grain portion 6 is cleaned by the coolant to which the ultrasonic wave is applied while driving to rotate the blade.

As described above, when the ultrasonic wave is applied to the coolant stored in the coolant pockets 8 and 8', and the blade-abrasive-grain portion 6 is cleaned by the coolant to which the ultrasonic wave is applied while driving to rotate the blade, the cleaning effect on the blade 2 can be more surely improved by the ultrasonic wave that is applied to the coolant. At this point, the ultrasonic wave may be applied to the coolant stored in all the arranged coolant pockets 8 and 8', or to some of them only.

Here, the frequency of the ultrasonic wave may be, for example, 400 to 460 KHz and the power thereof may be 13 to 17 W. But these are not restricted in particular.

In this case, a silicon ingot having a diameter of 300 mm or more can be used as the ingot 4.

As described above, even when the silicon ingot having a large diameter of 300 mm or more is used as the ingot 4, the coolant can be supplied efficiently and sufficiently by putting the coolant on the blade-abrasive-grain portion 6, according to the present invention, and the cooling effect on the cutting area and the cleaning effect on the blade-abrasive-grain portion 6 can be thereby improved.

Hereinafter, the present invention will be explained in more detail based on Examples and Comparative Example, but the present invention is not restricted thereto.

Example 1

With the ingot cutting apparatus according to the present invention, having a coolant pocket as shown in FIG. 1, and FIG. 3, a single crystal silicon ingot having a diameter of 301 mm was cut into a block, sori on the cutting surface of the cut block was measured, and the lifetime of the blade was evaluated. At this point, the blade in which the thickness of the blade-abrasive-grain portion was 0.65 mm (the thickness of the blade base was 0.3 mm) was used. The traveling speed of the blade was 1100 m/min. Pure water having a specific resistance of 17.5 MΩ·cm was used as the coolant.

The ingot was repeatedly cut into a block. When the displacement amount of the edge deflection of the blade became 200 μm or more, the number of cutting up to that time was measured as the lifetime of the blade. The blade was changed for a new one at the end of the lifetime of the blade, and these were repeated up to 10 times to evaluate the lifetime of the blade.

As a result, it was revealed that the maximum value of sori on the cutting surface was 250 μm, and that it was smaller than 500 μm that was the result of the later-explained Comparative Example. Moreover, it was confirmed that the failure of the cutting surface was thereby halved from 0.1% to 0.05%.

Figure 5:
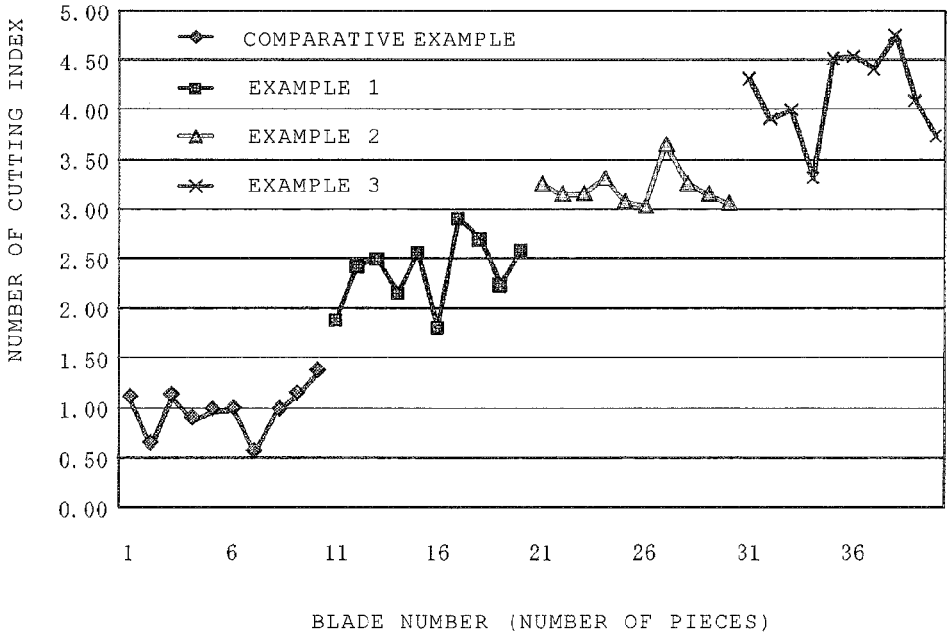
FIG. 5 is a graph showing the result of the lifetime of the blade in Examples 1 to 3, and Comparative Example.

FIG. 5 shows the result of the lifetime of the blade. FIG. 5 is a graph showing the relationship between a blade number and the lifetime of the blade, where an average value of the lifetime of the blade in Comparative Example was 1. The lifetime of the blade was the total number of cutting when the displacement amount of the edge deflection of the blade became 200 μm or more. As shown in FIG. 5, it was confirmed that the lifetime of the blade was more improved than the result of the later-described Comparative Example.

Moreover, the blade-abrasive-grain portion was observed with a 200-power optical microscope to investigate a status of attached cutting chips at the blade-abrasive-grain portion after the ingot was cut into a block once. As a result, it was confirmed that the investigated status of the attached cutting chips was approximately the same as that at the blade-abrasive-grain portion subjected to dressing process after an ingot was cut into a block in the later described Comparative Example, and the cleaning effect of the coolant was thus improved.

As described above, it was confirmed that the ingot cutting apparatus and the ingot cutting method according to the present invention enable the cooling effect and the cleaning effect on the blade-abrasive-grain portion to be improved by sufficiently supplying the coolant, and consequently enable the cutting precision and the lifetime of the blade to be improved.

Example 2

An ingot was cut into a block while the ultrasonic wave was applied to the coolant stored in the coolant pocket with the provided ultrasonic wave propagation means, in addition to the same conditions as Example 1, and the lifetime of the blade was evaluated as with Example 1. At this point, the frequency of the ultrasonic wave was 430 KHz, and the power thereof was 15 W.

FIG. 5 shows the result. As shown in FIG. 5, it was confirmed that the lifetime of the blade was more improved than the result of the later-described Comparative Example, and further it was more improved than Example 1.

Example 3

As shown in FIG. 4, two coolant pockets and two ultrasonic wave propagation means were provided so that one of the coolant pockets was arranged at the respective positions of the front and the rear of an ingot with respect to the direction of driving to rotate the blade, in addition to the same conditions as Example 2. The ingot was cut into a block while the ultrasonic wave was applied to the coolant stored in the coolant pockets. The displacement amount of the edge deflection of the blade was measured during cutting, and when the displacement amount became 100 μm or more, the direction of driving to rotate the blade was changed before the next cutting into a block. The lifetime of the blade was evaluated as with Example 2.

FIG. 5 shows the result. As shown in FIG. 5, it was confirmed that the lifetime of the blade was more improved than the later-described Comparative Example, and further it was more improved than Example 2.

Comparative Example

Figure 6:
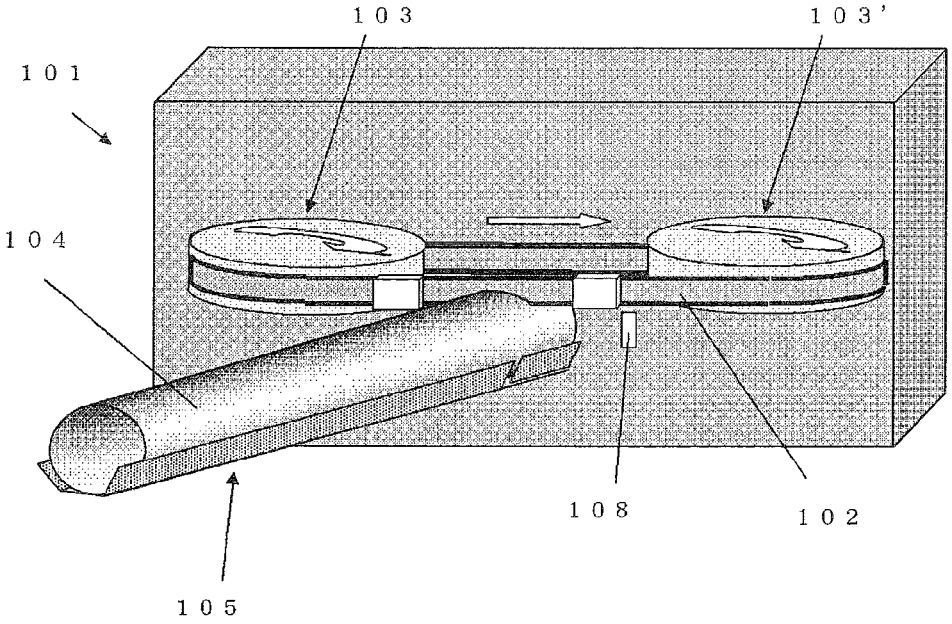
FIG. 6 is a schematic view showing an example of a conventional ingot cutting apparatus.

An ingot was cut into a block in the same conditions as Example 1 except for using a conventional ingot cutting apparatus that supplies the coolant with a nozzle as shown in FIG. 6, and sori on the cutting surface of the cut block and the lifetime of the blade were evaluated as with Example 1.

As a result, the maximum value of sori on the cutting surface was 500 μm, and it became worse than Example 1.

FIG. 5 shows the result of the lifetime of the blade. As shown in FIG. 5, it was confirmed that the lifetime of the blade became worse than Example 1.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. An ingot cutting apparatus including a cutting table on which an ingot is horizontally placed, and an endless-belt blade provided in a tensioned state between pulleys, the blade having a blade-abrasive-grain portion and a blade base, the ingot cutting apparatus cutting the ingot by relatively feeding the blade from above to below against the ingot while driving to rotate the blade by rotating the pulleys and supplying a coolant to the blade, the ingot cutting apparatus comprising at least two coolant pockets storing the coolant to be supplied to the blade and a pair of static pressure pads having coolant-spraying outlets through which coolant is sprayed toward the blade, the static pressure pads being arranged opposite one another at a predetermined interval so as to allow the blade to pass through, wherein the blade-abrasive-grain portion is brought into contact with the coolant stored in the at least two coolant pockets by causing the blade-abrasive-grain portion of the blade to travel through a groove portion provided at an upper portion of the at least two coolant pockets while driving to rotate the blade so that the coolant is supplied to the blade-abrasive-grain portion of the blade, the at least two coolant pockets are arranged below the static pressure pads, and the coolant sprayed through the coolant-spraying outlets of the static pressure pads is stored in the at least two coolant pockets, wherein at least one of the at least two coolant pockets is arranged at respective positions of a front and a rear of the ingot with respect to a direction of driving to rotate the blade, and wherein a number of the coolant pockets is the same as a number of the arranged static pressure pads.

2. The ingot cutting apparatus according to claim 1, wherein the pulleys are configured to be rotatable about an axis thereof in both directions, and the direction of driving to rotate the blade can be changed to cut the ingot.

3. The ingot cutting apparatus according to claim 1, wherein the coolant is pure water having a specific resistance of 17 MΩ·cm or more.

4. The ingot cutting apparatus according to claim 1, further comprising an ultrasonic wave propagation means for applying an ultrasonic wave to the coolant stored in the at least two coolant pockets.

5. The ingot cutting apparatus according to claim 1, wherein the ingot is a silicon ingot having a diameter of 300 mm or more.

6. The ingot cutting apparatus according to claim 1, wherein the coolant-spraying outlets are configured to spray coolant toward the blade in a direction substantially perpendicular to the direction of driving to rotate the blade when the blade-abrasive-grain portion of the blade travels through the groove portion of the at least two coolant pockets.

7. An ingot cutting method including: horizontally placing an ingot on a cutting table; providing an endless-belt blade in a tensioned state between pulleys, the blade having a blade-abrasive-grain portion and a blade base; driving to rotate the blade by rotating the pulleys; and cutting the ingot by relatively feeding the blade from above to below against the ingot while supplying a coolant to the blade, wherein a pair of static pressure pads having coolant-spraying outlets through which coolant is sprayed toward the blade are arranged opposite one another at a predetermined interval so as to allow the blade to pass through, at least two coolant pockets for supplying the coolant to the blade are arranged below the static pressure pads, the coolant sprayed through the coolant-spraying outlets of the static pressure pads is stored in the at least two coolant pockets, and the coolant is supplied to the blade-abrasive-grain portion of the blade in such a manner that the blade-abrasive-grain portion is brought into contact with the coolant stored in the at least two coolant pockets by causing the blade-abrasive-grain portion of the blade to travel through a groove portion provided at an upper portion of the at least two coolant pockets while driving to rotate the blade, wherein at least one of the at least two coolant pockets is arranged at respective positions of a front and a rear of the ingot with respect to a direction of driving to rotate the blade, and the coolant is supplied through the at least two coolant pockets, and wherein a number of the coolant pockets is the same as a number of the arranged static pressure pads.

8. The ingot cutting method according to claim 7, wherein after the ingot is cut with the blade driven to rotate in one direction, the direction of driving to rotate the blade is changed into a direction opposite to the one direction, and thereafter the ingot is continuously cut or a next ingot is cut.

9. The ingot cutting method according to claim 7, wherein pure water having a specific resistance of 17 MΩ·cm or more is used as the coolant.

10. The ingot cutting method according to claim 7, an ultrasonic wave is applied to the coolant stored in the at least two coolant pockets, and the blade-abrasive-grain portion is cleaned by the coolant to which the ultrasonic wave is applied while driving to rotate the blade.

11. The ingot cutting method according to claim 7, wherein a silicon ingot having a diameter of 300 mm or more is used as the ingot.

12. The ingot cutting method according to claim 7, further comprising spraying coolant from the coolant-spraying outlets toward the blade in a direction substantially perpendicular to the direction of driving to rotate the blade when the blade-abrasive-grain portion of the blade travels through the groove portion of the at least two coolant pockets.

* * * * *